US005476335A

United States Patent [19]

Whaley

[11] Patent Number: 5,476,335

[45] Date of Patent: Dec. 19, 1995

[54] LOCKING MECHANISM FOR A RING BINDER

[75] Inventor: Paul Whaley, Bonne Terre, Mo.

[73] Assignee: U.S. Ring Binder Corp., New Bedford, Mass.

[21] Appl. No.: 414,200

[22] Filed: Mar. 31, 1995

[51] Int. Cl.[6] ..... B42F 13/00

[52] U.S. Cl. ..... 402/26; 402/38; 402/41

[58] Field of Search ..... 402/26, 31, 36, 402/38, 39, 41

[56] References Cited

U.S. PATENT DOCUMENTS

| | | | |
|---|---|---|---|
| 3,884,586 | 5/1975 | Michaelis | 402/38 |
| 3,954,343 | 5/1976 | Thomsen | 402/41 |
| 3,995,961 | 12/1976 | Dorfman et al. | 402/38 |
| 4,919,557 | 4/1990 | Podosek | 402/38 |
| 5,067,840 | 11/1991 | Cooper | 402/38 |

*Primary Examiner*—Willmon Fridie, Jr.
*Attorney, Agent, or Firm*—Polster, Lieder, Woodruff & Lucchesi

[57] ABSTRACT

A locking assembly (10) is for use in a ringbinder (12) used to hold and store sheets (S) of paper or other material in which at least one hole (H) is punched for capturing the sheet of paper and holding it in place. The assembly includes at least one binder ring (14). Each binder ring has first and second mating segments (14*a*, 14*b*). These are movable into and out of contact with each other. A sheet of paper is inserted onto one of the ting segments, when the segments are out of contact with each other, by inserting the hole in the sheet of paper over the ting segment. One end of one of the ring segments is attached to a first elongated plate (48), and a corresponding end of the other ring segment is attached to a second elongated plate (50). The plates are positioned side-by-side and extend generally parallel to each other. Respective levers (54, 56) are located adjacent opposite ends of the assembly for simultaneously moving each of the two plates from a first position in which the ring segments are in contact with each other to a second position in which the ring segments are spaced apart from each other. The first position comprises a ringbinder closed position, and the second position a ringbinder open position. A manually operable lever actuator (62, 64) is operable to move each lever to open the ringbinder. The actuator is positioned intermediate the ends of the two plates. The profile of the actuator is such that it is generally flush with the sides of the plates. Paper inserted into the ringbinder will overlay the lever actuator. And, the lever actuator is operable even when a substantial number of sheets of paper are inserted into the ringbinder. Accordingly, the ringbinder can be used to hold sheets of paper the length and width of which generally correspond with the length and width of the ringbinder.

22 Claims, 4 Drawing Sheets

LOCKING MECHANISM FOR A RING BINDER

BACKGROUND OF THE INVENTION

This invention relates to ring binders for holding or storing sheets of paper or a similar material in which holes are punched, and more particularly, an improved locking mechanism for such binders.

Ringbinders are well known in the art. They are commonly used by schoolchildren, business and professional people, and a wide variety of others. A ringbinder is typically used to hold and store punched sheets of paper; although, other suitably punched materials can also be held in a ringbinder. The locking mechanism commonly used in ringbinders includes a thumb or finger operated latch located at each end of the mechanism. To operate the mechanism, the user presses against the latch to pull apart (open) the binder rings. Papers can then be inserted or removed from the binder. When ready, the user presses against the respective sections of a ring or rings to snap them into their closed position.

The current locking mechanism has certain drawbacks. One of these is that its construction limits the size of the paper or material held or stored in a ringbinder. This is because the latch extends out from the locking mechanism so far that paper larger than a particular size will have to ride up over a portion of the latch. Thus, the paper held in a binder must usually be smaller than the binder dimensions. A second drawback has similar origins to the first. That is, because the paper held in a binder will typically be smaller than the binder, greater space is required to store paper of a certain size (or the binders holding the papers). If the size of the binder must be larger than the optimal size of the paper held in the binder, shelf space for the binders must be larger than would otherwise be necessary. Further, there is usually a thumb latch located at each end of the binder. The space needed to accommodate both latch members further increases the size of binder needed to store a given size of paper. If a latch mechanism could be designed which allowed the size of the binder and the paper held in the binder to correspond to each other, certain savings would be realized. This would further be true if the locking assembly, at the same time, provided both ease of opening and closing.

SUMMARY OF THE INVENTION

Among the several objects of the present invention may be noted the provision of an improved latch mechanism for ringbinders, folders, and similar types of holders for retaining and storing paper and similar material. An improved latch mechanism is provided which allows a ringbinder generally corresponding to the size of the paper stored in the ringbinder to be used, usage of such a ringbinder providing for more efficient storage. Because paper can now be stored in a ringbinder which is requires less upright space, more effective usage of shelf space is possible. The improved latch mechanism provides quick and easy opening and closing of a ringbinder so paper storage and retrieval is as least as efficient as with ringbinders having conventional latch mechanisms. The improved latch mechanism allows for opening and closing the ringbinder by a simple pressing action and does not require usage of thumb latches or pulling apart of binder rings to open the ringbinder to access papers. The improved latch mechanism further facilitates this easy access even if the size of paper stored in a ringbinder causes it to cover the latch mechanism. The latch mechanism eliminates the need of thumb latches at either or both ends of a ringbinder for opening the binder. This reduces cost. Further, the latch mechanism of the present invention is available in various sizes so to be usable in different size ringbinders, all of which will store paper generally corresponding to the size of the binder. Finally, the latch mechanism is a low cost mechanism which is easy to manufacture and install in a ringbinder so usage of the improved ringbinder does not increase the overall cost of the ringbinder.

In accordance with the invention, generally stated, a locking assembly is for use in a ringbinder used to hold and store sheets of paper or other material in which at least one hole is punched for capturing the sheet of paper and holding it in place. The assembly includes at least one binder ring. Each binder ring has first and second maring segments. These are movable into and out of contact with each other. A sheet of paper is inserted onto one of the ring segments, when the segments are out of contact with each other, by inserring the hole in the sheet of paper over the ring segment. One end of one of the ring segments is attached to a first elongated plate, and a corresponding end of the other ring segment is attached to a second elongated plate. The plates are positioned side-by-side and extend generally parallel to each other. Respective levers are located adjacent opposite ends of the assembly for simultaneously moving each of the two plates from a first position in which the ring segments are in contact with each other to a second position in which the ring segments are spaced apart from each other. The first position comprises a ringbinder closed position, and the second position a ringbinder open position. A manually operable lever actuator is operable to move each lever to open the ringbinder. The profile of the actuator is such that it is generally flush with the sides of the plates. Paper inserted into the ringbinder will overlay the lever actuator. And, the lever actuator is operable even when a substantial number of sheets of paper are inserted into the ringbinder and overlay the actuator. Accordingly, the ringbinder can be used to hold sheets of paper the length and width of which generally correspond with the length and width of the ringbinder. Other objects and features will be in part apparent and in pan pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
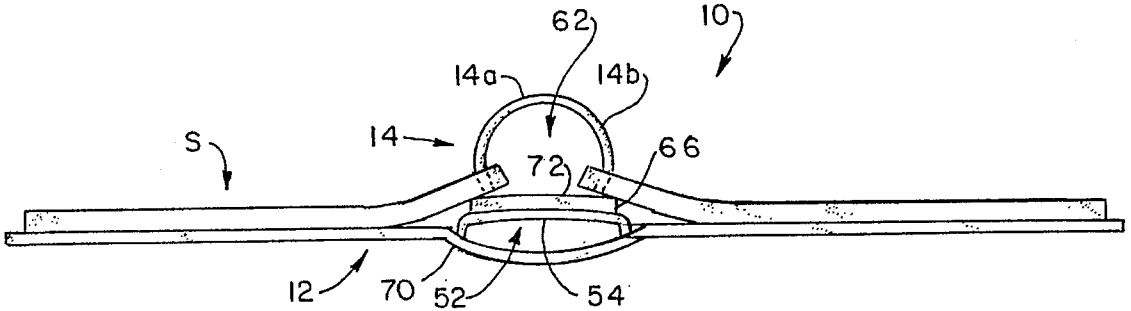
FIG. 1 is an end elevational view of a ringbinder with the locking mechanism of the present invention for holding and storing punched paper or a similar material in the binder.

Referring to the drawings, a ringbinder assembly of the present invention is indicated generally 10 in FIG. 1. The assembly is used in a ringbinder 12, or a similar type folder used to hold and store sheets S of paper. The sheets of paper have holes H punched in them and the sheets are secured in the ringbinder by inserring the holes over a binder ring segment 14A, 14B as described hereinafter.

Figure 2:
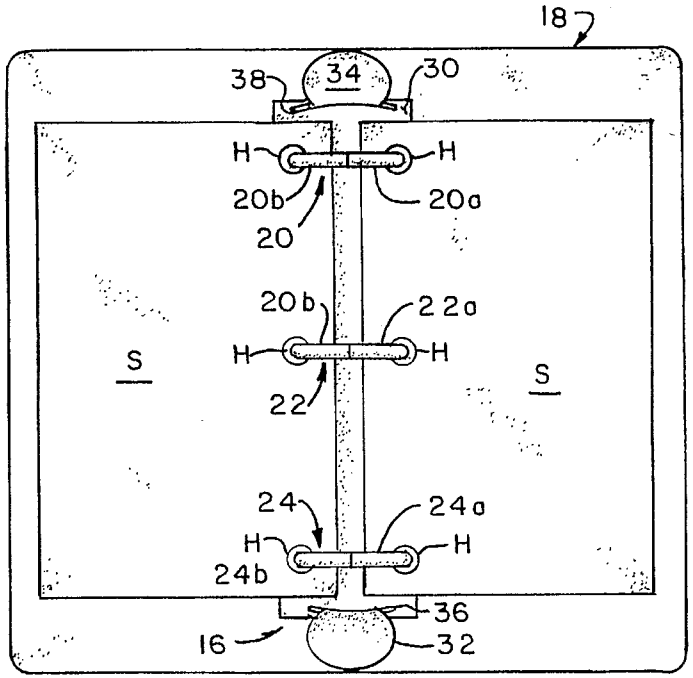
FIG. 2 PRIOR ART
FIG. 2 is a plan view of a ringbinder with a prior an locking mechanism shown in the binder open position.
Figure 3:
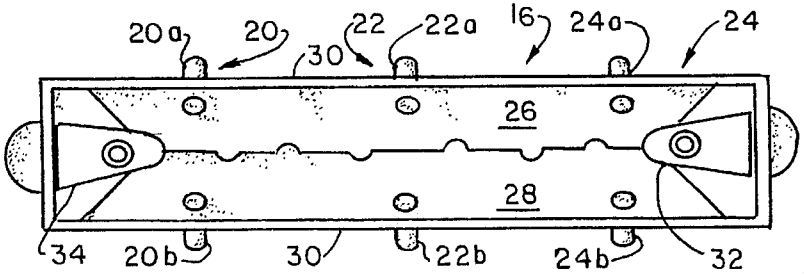
FIG. 3 PRIOR ART
FIG. 3 is a bottom plan view of a prior an locking mechanism.

Referring to FIGS. 2 and 3, a prior art ringbinder assembly 16 is shown for use with a binder 18. The prior art assembly is shown to include three binder rings 20, 22, 24 respectively for illustrative purposes only. Each binder ring has respective segments; for example, ring segments 20*a*, 20*b*. The binder ring segments are respectively attached to interlocking plates 26, 28. The plates are mounted within a cover plate 30 which has openings (not shown) in its upper surface through which the respective ring segments project. The sides of the cover plate are folded over, about the sides of the respective plates to capture the plates and hold them in place. Respective lever arms 32, 34 are mounted at opposite ends of the assembly to move plates 26, 28 and effect opening of the binder rings. One end of the lever arms operate against respective ends of the plates. The lever arms extend upwardly through respective openings 36, 38 in cover plate 30. The outer ends of the respective lever arms extend beyond the ends of the cover plate, and these outer ends form an enlarged pad. Someone attempring to open the binder places their thumbs or fingers on each pad and presses down. The resulring force pivots the lever arms about respective posts 40, 42 to effect opening of the binder ring.

The prior art assembly has certain drawbacks. In particular, the lever arm construction, with the outer ends of the lever arms extending outwardly as they do, limit the size of paper which can be held in the binder. More appropriately stated, the binder must be made sufficiently larger than the size of paper used in the binder so the assembly does not interfere with paper storage in the binder. If the binder were made smaller, the ends of the sheets of paper would tide up on the outer projecring portion of the lever arms. The resulring distortion would cause the paper to be bent out of shape, and less paper could be stored in the binder than should be possible. A secondary factor relaring to this is that when the binder is stored vertically; e.g., placed side-by-side on a shelf, the binder takes up more space than it should. This is because the binder must have sufficient height to enclose the pad portions of the lever arms. Because of this prior art construction, the cost of a binder for use with a given size of paper is larger than it could be, and the storage or shelving capabilities for such binders is reduced.

Figure 4:
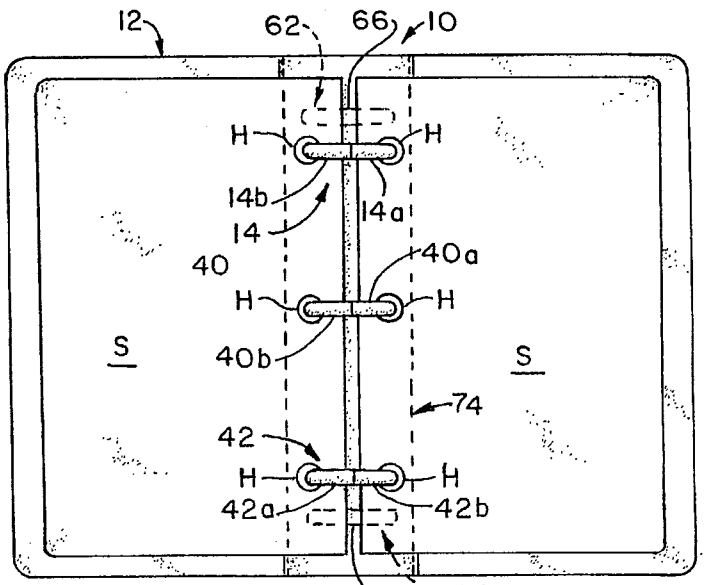
FIG. 4 is a plan view of a ringbinder with a locking mechanism of the present invention shown in the binder open position.

The binder of the present invention, as described hereinafter, not only solves these problems, but also provides an easier to open binder having more paper capacity than binders using the prior art assembly construction. As noted, locking assembly 10 is used in a ringbinder 12 to hold and store sheets of paper and similar material. For proper storage, the paper or material has at least the same number of punched holes as there are binder rings in the assembly. Assembly 12 has at least one binder ring 14, and preferably a plurality of binder rings. Three such binder rings 14, 40, and 42 respectively, are shown in FIG. 4. It will be understood that the assembly could comprise two or four binder rings, for example, without deparring from the scope of the invention. Each binder ring has first and second maring segments 14*a*, 14*b*, 40*a*, 40*b*, and 42*a*, 42*b* which are movable into and out of contact with each other. As in the prior art assembly construction, when the ringbinder is open, as shown in FIG. 8B, a sheet of paper is inserted onto one of the ring segments, by inserring a hole in the sheet of paper over a ring segment.

Figure 6:
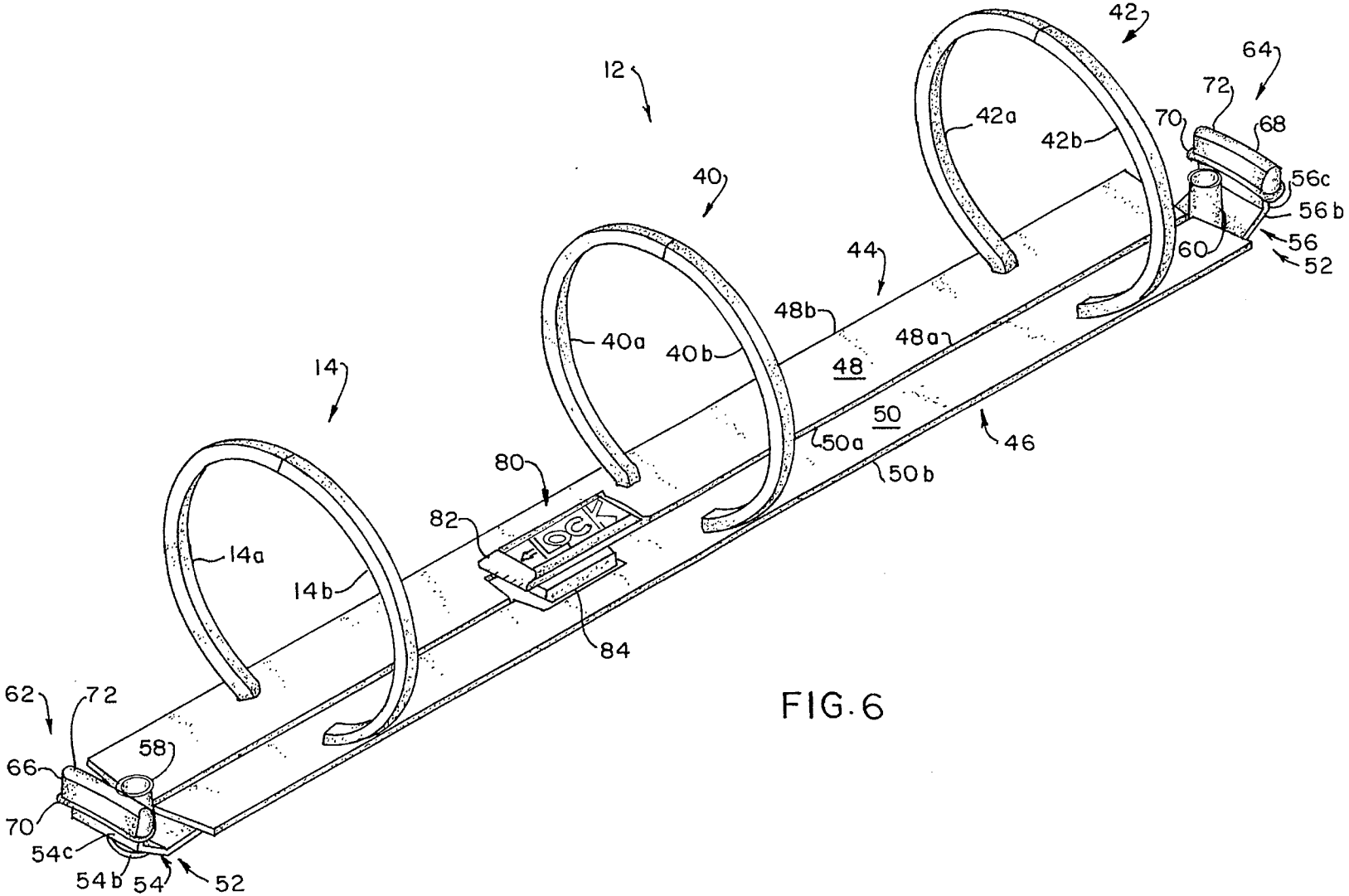
FIG. 6 is a perspective view similar to FIG. 5 but with the cover plate removed and showing an optional locking feature.

Assembly 10 next includes a first holding means 44 to which one end of one of the ring segments is of each binder ring is attached. The assembly further includes a second holding means 46 to which a corresponding end of the other of ring segments of the binder rings is attached. The respective holding means each comprise a respective elongate plate 48, 50. As best shown in FIG. 6, plates 48 and 50 are rectangularly shaped. Further, the plates are arranged such that the longer sides of the plates extend parallel to each other in an abutring relationship. As shown in FIG. 8A and 8B, one end of each of the corresponding ring segments of the binder rings are attached to each plate. Thus, one end of ring segment 14*a* is staked or otherwise secured to plate 48. So, also, are ring segments 40*a* and 42*a*. Similarly, one end of ring segments 14*b*, 40*b*, and 42*b* are secured to plate 50.

Figure 7:
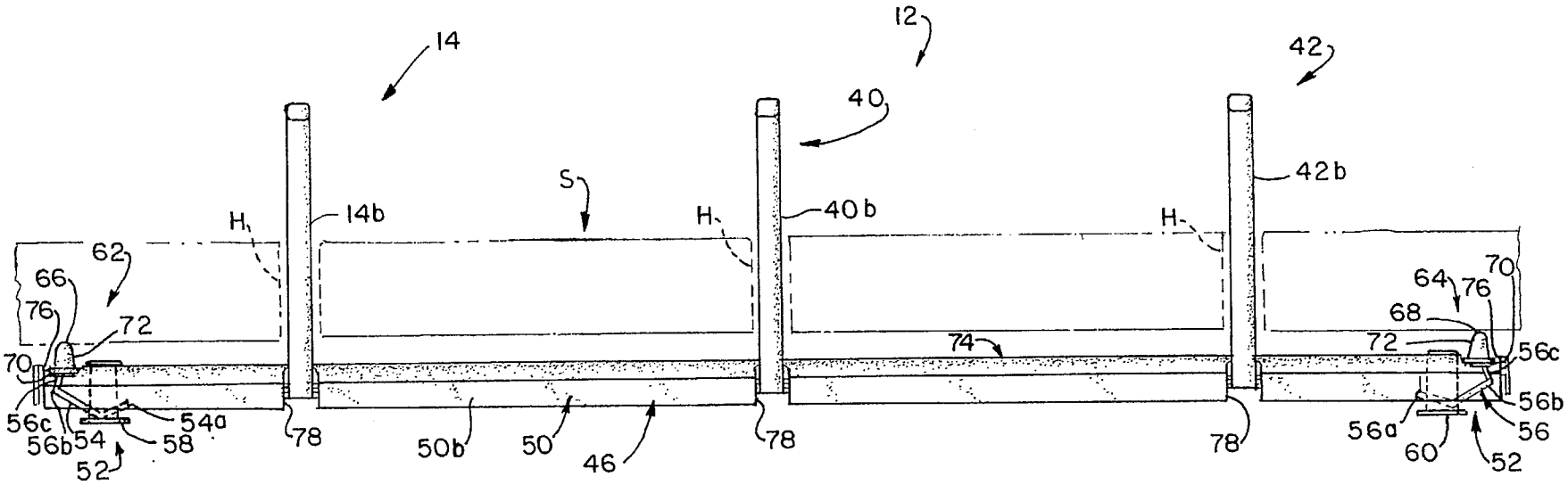
FIG. 7 is a side elevational view of the locking mechanism.
Figure 8B:
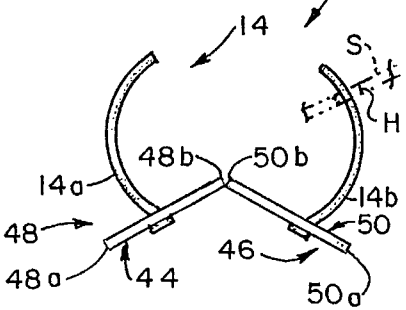
FIG. 8A illustrates a first locking assembly position, and FIG. 8B a second position of the locking assembly.
Figure 8A:
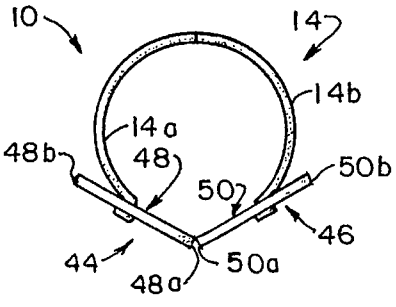

As best shown in FIGS. 8A and 8B, plates 48 and 50 are movable relative to each other. between ringbinder closed (FIG. 8A) and ringbinder open (FIG. 8B) positions. In FIG. 6, it is shown that in the ringbinder closed position one side 48*a*, 50*a* of plates 48 and 50 extend parallel of and adjacent to each other. When the ringbinder is opened, as shown in FIG. 8B, the plates are toggled to a position in which the opposite side 48*b*, 50*b* respectively of the plates extend parallel of and adjacent to each other. Assembly 10 includes a lever means indicated generally 52 for simultaneously moving plates 48 and 50 from the ringbinder closed position in which the ring segments are in contact with each other, to the ringbinder open position in which said the segments are spaced apart from each other. Means 52 includes respective first and second levers 54, 56 which are positioned adjacent opposite ends of plates 48, 50. Each lever includes a first lever arm 54*a*, 54*b* which extends beneath the plates, and contacts the plates adjacent their respective ends (see FIG. 7). Each lever further includes a second arm 54*b*, 56*b*. As best shown in FIG. 7, lever arms 54*a*, 54*b*, and 56*a*, 56*b*, are angled with respect to each other. The juncture between the respective lever arms forms a pivot for moving the levers to apply a lever force at end of the respective plates 48, 50 to move the plates. A respective post 58, 60 located at the ends of the assembly provide a pivoring surface against which the lever arms pivot to apply the levering force against plates 48, 50 to move the plates. Each post has a frusto-conical upright center section 62, with an annular flange 64 extending radially outwardly from the base of section 62. The respective lever arms have circular cut-outs for fitring the levers onto the posts so the levers can pivot about the posts. That is, the juncture between the respective lever arms forms a pivot point which rests upon the flange portion of each post for pivotal movement of the lever. Finally, at the outer end of each second lever arm 54*b*, 56*b*, there is a vertical arm segment 54*c*, 56*c*. A vertical force applied to the respective arms 54*c*, 56*c*, causes pivoring of the lever 54 or 56 to open the ringbinder.

Figure 5:
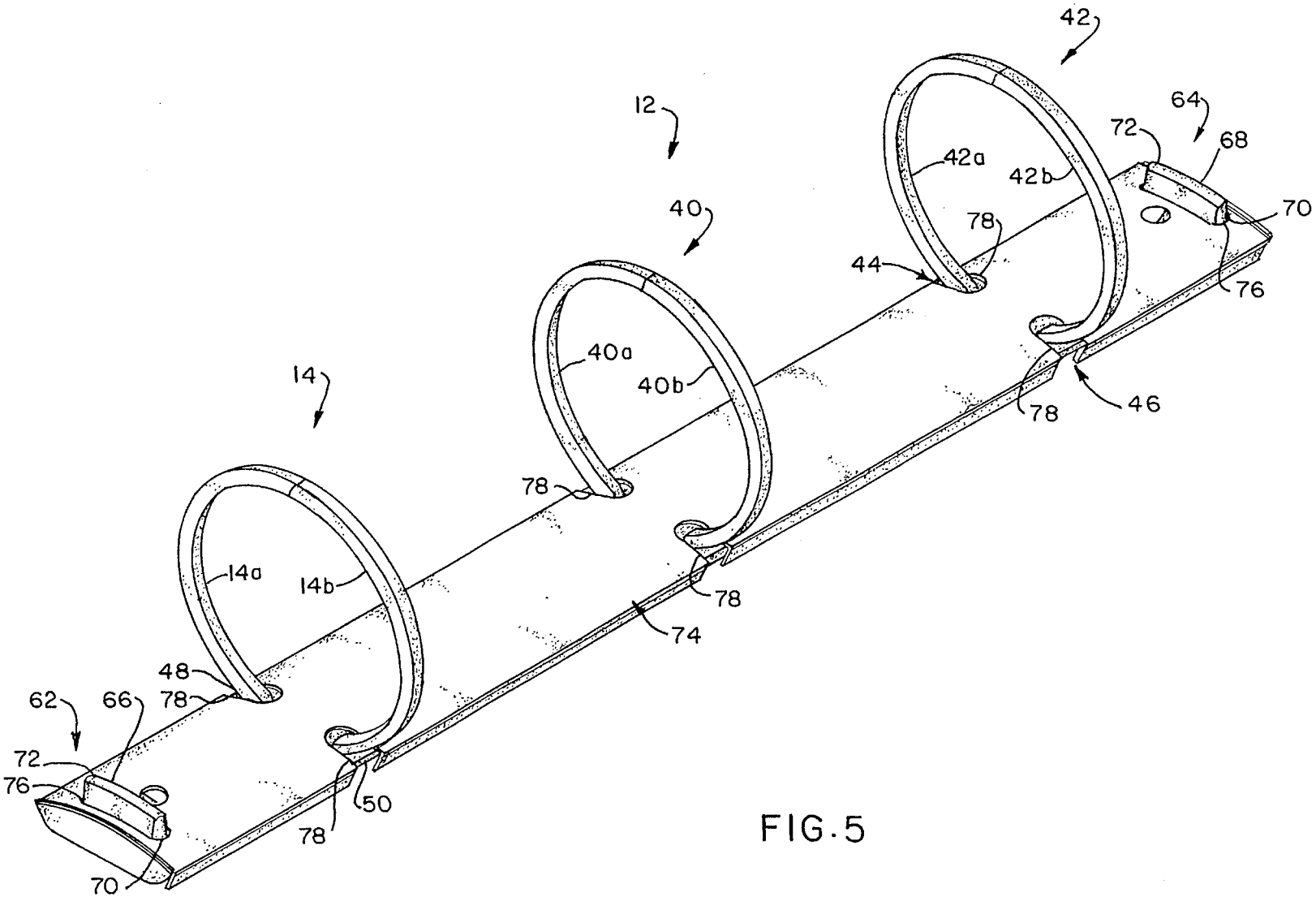
FIG. 5 is a perspective view of the locking mechanism of the present invention with a cover plate installed.

Assembly 10 next includes a manually operable lever activaring means 62, 64 for moving the respective levers 54, 56 to open the ringbinder. These lever activaring means are positioned intermediate the ends of the assembly. Each lever activaring means includes a pusher means or pusher 66, 68 respectively contacring the lever arm segments 54*c*, 56*c*, of the lever arms 54*b*, 56*b*. Each pusher comprises a base section 70 which fits over lever arm segments 54*c*, 56*c*. The base section is wider than the width of these arm sections, and the base has a slight curvature from side of the base to the other. This curvature is a concave curvature extending inwardly toward the center of the assembly. Extending upwardly (as viewed in FIGS. 5–7) from the base is a tapering, curved contact pad 72. The height of this pad is such that it creates a low profile with respect to the remainder of the locking assembly. This, even though the contact pads extend slightly above the upper ends of the plates 48, 50. By being generally flush with the upper ends of the plates, the pads permit paper inserted in ringbinder 12 to overlay the pushers as shown in FIGS. 4 and 7. Accordingly, as shown in FIG. 1, when sheets of paper are stored in binder 12, the sheets lay generally flat. At the inner end of the sheets, where they are inserted onto the binder rings, there is a slight sloping of the paper. More importantly, however, the pushers are located not at the end of the assembly as are the pads 32, 34 of the prior art assembly. This means that for comparable size sheets S, the ringbinder 12 using the assembly 10 of the present invention can actually be smaller than a ringbinder 18 with which the prior art assembly is used. That is, unlike the ringbinder 18, ringbinder 12 can be used to hold sheets of paper the length and width of which generally correspond with the length and width of the ringbinder. A side-to-side comparison of the prior art binder 18 with binder 12 illustrates this savings in binder size for storing comparable sheets of paper. This, in turn, means certain savings in storage space can be realized when ringbinders 12 are stored.

As shown in FIG. 7, a substantial number of sheets of paper are insertable into the ringbinder and over lay the pushers 66, 68. Regardless of the number of sheet so inserted, to open the ringbinder simply requires pushing down upon the sheets of paper at a point above one of the pushers. There is no necessity of actually having to physically contact the pusher to exert sufficient force on the pusher to activate one of the levers and open the ringbinder. Further, the assembly includes a cover plate 74 which fits over the plates and levers. Plate 74 has a concave upper surface. The width of the cover plate is such that it encloses the remainder of the locking assembly except for the pad portions 70 of the pushers. The plate has elongate slots 76 formed in its upper surface to accommodate the lower portion of the pushers 66, 68. There are also elongate slots 78 extending inwardly from the sides of the plate toward its center. These slots are formed at the location of the binder rings and are allow the curved binder ring segments to freely move without interference.

Finally, locking assembly 10 includes a lock indicated generally 80 for locking the assembly in the ringbinder closed position. Lock 80 includes a slidable finger pad 82 which a user can move longitudinally of the locking assembly. Pad 82 is attached to a locking block 84 whose upper surface is angled with respect to plates 48, 50. When moved to its locking position, lock 80 prevents the movement of the plates from their position shown in FIG. 8A (the ringbinder closed position) to their position in FIG. 8B (the open position). When the lock 80 is moved to its normal unlocking position, the plates are freely movable in response to pressure on one of the respective levers.

Once the ringbinder is open, to close the ringbinder requires only that the user press the ring segments of one of the binder rings together. This action will move close all of the rings and cause the plates 48, 50 to be snapped back to their FIG. 8A positions closing the ringbinder. As a result, there is very little manual force required to either open or close the ringbinder. And, this is so even when a large quantity of paper is stored or held in the ringbinder.

What has been described is an improved latch mechanism for ringbinders, folders, and other types of paper holders for holding and storing papers and similar materials. An improved latch mechanism allows the size of the ringbinder to now more generally correspond to the size of the paper stored in the ringbinder; rather than the ringbinder having to be larger than the paper. Usage of such a ringbinder will provides for more efficient storage of papers since papers can now be stored in a ringbinder which make more effective usage of available shelf space. The above described latch mechanism facilitates quick and easy opening and closing of a ringbinder. This makes paper storage and retrieval as efficient as with conventional ringbinders. The improved operation of the latch mechanism permits opening and closing of a ringbinder by a simple pressing action. It does not require usage of thumb latches or the pulling apart of binder rings in order to access papers. This is so, even where the size of the paper stored in a ringbinder covers the latch mechanism. The latch mechanism eliminates the need of thumb latches at either or both ends of a ringbinder for opening the binder. In addition, the latch mechanism can be made in various sizes so it can be used in a variety of different size ringbinders. In each instance, the ringbinder can be used to store paper which generally corresponds to the size of the binder. The latch mechanism of the present invention is a low cost mechanism that is easy to manufacture and readily installed in a ringbinder. Accordingly, use of the improved ringbinder does not effect the cost of ringbinders.

In view of the foregoing, it will be seen that the several objects of the invention are achieved and other advantageous results are obtained.

As various changes could be made in the above constructions without deparring from the scope of the invention, it is intended that all matter contained in the above description or shown in the accompanying drawings shall be interpreted as illustrative and not in a limiring sense.

Having thus described the invention, what is claimed and desired to be secured by Letters Patent is:

1. A locking assembly for use in a ringbinder used to hold and store sheets of paper and similar material in which at least one hole is punched to capture a sheet of paper and hold it in place, comprising:

at least one binder ring, said binder ring having first and second maring segments movable into and out of contact with each other, a sheet of paper being inserted onto one of the ring segments, when the segments are out of contact with each other, by inserring the hole in the sheet of paper over the ring segment;

first holding means to which one end of one of said ring segments is attached, and second holding means to which a corresponding end of the other of said segments is attached;

lever means for simultaneously moving said first and second holding means from a first position in which said ring segments are in contact with each other to a second position in which said ring segments are spaced apart from each other, said first position comprising a ringbinder closed position, and said second position comprising a ringbinder open position; and, manually operable lever activaring means for moving said lever means to open said ringbinder, said lever activaring means being positioned intermediate the ends of said assembly, and the profile of said lever activaring means being generally flush with said holding means for paper inserted in said ringbinder to overlay said lever activaring means with said lever activaring means being operable even when a substantial number of sheets of paper are inserted in said ringbinder whereby said ringbinder can be used to hold sheets of paper the length and width of which generally correspond with the length and width of the ringbinder.

2. The locking assembly of claim 1 further including a plurality of binder rings spaced apart from each other, each binder ring having first and second maring segments movable into and out of contact with each other, and the sheet of paper having a plurality of spaced holes corresponding in separation to the distance between adjacent binder rings, a sheet of paper being inserted onto one of the ring segments, when the segments are out of contact with each other, by inserring the holes in the sheet of paper over the corresponding ring segment of the respective binder rings.

3. The locking assembly of claim 2 wherein said first and second holding means each comprise an elongate plate to each of which one end of a corresponding ring segment of said binder rings is attached, said plates being movable relative to each other.

4. The locking assembly of claim 3 wherein said elongate plates are rectangular plates with the plates being arranged such the longer sides of the plates extend parallel to each other.

5. The locking assembly of claim 4 wherein said elongate plates are movable between said ringbinder open and closed positions.

6. The locking assembly of claim 5 wherein said elongate plates are movable such that in said ringbinder closed position one side of each of said plates extend parallel of and adjacent to each other, and in said ringbinder open position the opposite side of each of said plates extend parallel of and adjacent to each other.

7. The locking assembly of claim 6 wherein said lever means includes first and second levers which are positioned adjacent opposite ends of said plates.

8. The locking assembly of claim 7 wherein each lever includes a first lever arm which extends beneath said elongate plates, one end of said first lever arms contacring said elongate plates adjacent an end of said plates, and the other end of said first lever arms forming a pivot about which said first lever arms move to move said plates from said ringbinder closed to said ringbinder open position.

9. The locking assembly of claim 8 wherein said lever means further includes respective posts against which said one end of each of said first lever arms pivots for applying a levering force against said elongate plates to move said plates from said ringbinder closed to said ringbinder open positions.

10. The locking assembly of claim 9 wherein each of said levers further includes a second lever arm and said lever activaring means including respective pusher means contacring one of each of said second lever arms with the other end of each of said second lever arms forming a pivot with said other end of said first lever arms whereby pushing upon one of said first pusher means moves said respective lever to move said elongate plates.

11. The locking assembly of claim 10 further including a cover plate extending the length of said assembly and having a length exceeding that of said elongate plates for said cover plate to extend beyond each end of said elongate plates, said second arm of each of said levers also extending beyond the respective ends of said elongate plates, and said pusher means comprising respective pushers contacring said respective one ends of each of said second lever arms.

12. The locking assembly of claim 11 wherein said cover plate has a respective opening formed therein inwardly of the respective ends of said cover plate with each said pusher being manually movable through one of said openings for activaring said lever means.

13. The locking assembly of claim 1 further including locking means for locking said ringbinder in its closed position.

14. Locking apparatus for use in a ringbinder used to hold sheets of paper in which a plurality of holes are punched to capture a sheet of paper and hold it in place, comprising:

a plurality of binder rings spaced apart from each other, each binder ring having respective first and second maring segments movable into and out of contact with each other, a sheet of paper having a plurality of spaced holes whose spatial separation corresponds to that of adjacent binder rings, sheets of paper being inserted onto one of the ring segments, when the segments are out of contact with each other, by inserring the holes in the sheet of paper over the corresponding ring segment of the respective binder rings;

first and second holding means to which said ring segments are attached, corresponding ends of one of said ring segments being attached to one of said holding means, and corresponding ends of the other of said ring segments being attached to the other of said holding means;

lever means including first and second levers for simultaneously moving said first and second holding means from a first position in which said ring segments are in contact with each other to a second position in which said ring segments are spaced apart from each other, said first position being a ringbinder closed position, and said second position being a ringbinder open position; and, pusher means for pushing against one of each respective lever to open said ringbinder, said pusher means being located intermediate the ends of said first and second holding means and having a profile which is generally flush with said holding means for papers inserted in said ringbinder to overlay said pusher means, said pusher means being operable even when a substantial number of sheets of paper overlay said pusher means for said ringbinder to hold sheets of paper the length and width of which generally correspond with the length and width of the ringbinder.

15. The locking apparatus of claim 14 wherein said first and second holding means each comprise respective elongate plates to each of which one end of a corresponding ring segment of said binder rings is attached, said elongate plates being generally rectangular plates arranged such that the longer sides of the plates extend parallel to each other.

16. The locking apparatus of claim 15 wherein said elongate plates are movable relative to each other between said ringbinder open and closed positions.

17. The locking apparatus of claim 16 wherein each lever includes a first lever arm extending beneath said elongate plates, one end of said first lever arms contacring said elongate plates adjacent an end of said plates, and the other end of said first lever arms forming a pivot about which said first lever arms move to move said plates from said ringbinder closed to said ringbinder open position, and said lever means further including respective posts against which said one end of each of said first lever arms pivots for applying a levering force against said elongate plates to move said plates from said ringbinder closed to said ringbinder open positions.

18. The locking apparatus of claim 17 wherein each of said levers further includes a second lever arm with said pusher means contacring one of each of said second lever arms with the other end of each of said second lever arms forming a pivot with said other end of said first lever arms whereby pushing upon one of said first pusher means moves said respective lever to move said elongate plates.

19. The locking apparatus of claim 18 further including a cover plate extending the length of said assembly and having a length exceeding that of said elongate plates for said cover plate to extend beyond each end of said elongate plates, said second arm of each of said levers also extending beyond the respective ends of said elongate plates, and said pusher means comprising respective pushers contacring said respective one ends of each of said second lever arms.

20. The locking apparatus of claim 19 wherein said cover plate has a respective opening formed therein inwardly of the respective ends of said cover plate with each said pusher being manually movable through one of said openings for activaring said lever means.

21. The locking assembly of claim 14 further including locking means for locking said ringbinder in its closed position.

22. Locking apparatus for use in a ringbinder used to hold sheets of paper in which a plurality of holes are punched to capture a sheet of paper and hold it in place, comprising:

a plurality of binder rings spaced apart from each other, each binder ring having respective first and second maring segments movable into and out of contact with each other, a sheet of paper having a plurality of spaced holes whose spatial separation corresponds to that of adjacent binder rings, sheets of paper being inserted onto one of the ring segments, when the segments are out of contact with each other, by inserring the holes in the sheet of paper over the corresponding ring segment of the respective binder rings;

first and second holding means to which said ring segments are attached, corresponding ends of one of said ring segments being attached to one of said holding means, and corresponding ends of the other of said ring segments being attached to the other of said holding means, said holding means each comprising an elongate plates to each of which one end of a corresponding ring segment of said binder rings is attached, said elongate plates being generally rectangular plates arranged such that the longer sides of the plates extend parallel to each other and said plates being movable relative to each other;

lever means including first and second levers for simultaneously moving said first and second holding means from a first position in which said ring segments are in contact with each other to a second position in which said ring segments are spaced apart from each other, said first position being a ringbinder closed position, and said second position being a ringbinder open position, and said lever means further including respective posts against which said levers act for applying a levering force against said elongate plates to move said plates from said closed to said open position;

pusher means for pushing against one of each respective lever to open said ringbinder, said pusher means being located intermediate the ends of said first and second holding means and having a profile which is generally flush with said holding means for papers inserted in said ringbinder to overlay said pusher means, said pusher means being operable even when a substantial number of sheets of paper overlay said pusher means; and, a cover plate extending the length of said assembly and having a length exceeding that of said elongate plates for said cover plate to extend beyond each end of said elongate plates, said respective first and second levers being positioned beneath said cover plate at opposite ends thereof, and said cover plates having respective openings therein for said pusher means to contact said respective levers.

* * * * *

UNITED STATES PATENT AND TRADEMARK OFFICE

CERTIFICATE OF CORRECTION

PATENT NO. : 5,476,335

DATED : December 19, 1995

INVENTOR(S) : Paul Whaley

It is certified that error appears in the above-indentified patent and that said Letters Patent is hereby corrected as shown below:

In the Abstract (lines 8 and 10) delete "ting" and insert – ring –;

Column 2, line 19, delete "inserring" and insert – inserting –;

Column 2, line 41 delete "pan" and insert – part –;

Column 2, lines 48 and 51 delete "an" and insert – art –;

Column 3, line 8 delete "inserring" and insert – inserting –;

Column 3, line 29 delete "attempring" and insert – attempting –;

Column 3, line 31 delete "resulring" and insert -- resulting --;

Column 3, line 41 delete "projecring and insert -- projecting –;

Column 3, line 42 delete "resulring" and insert -- resulting –;

Column 3, line 44 delete "relaring" and insert -- relating –;

Column 3, line 64 delete "deparring" and insert -- departing --;

Column 3, line 65 delete "maring" and insert -- mating –;

Column 4, line 3 delete "inserring" and insert – inserting –;

UNITED STATES PATENT AND TRADEMARK OFFICE

CERTIFICATE OF CORRECTION

PATENT NO. : 5,476,335

DATED : December 19, 1995

INVENTOR(S) : Paul Whaley

It is certified that error appears in the above-indentified patent and that said Letters Patent is hereby corrected as shown below:

Column 4, line 14 delete "abutring" and insert -- abutting --;

Column 4, line 44 delete "pivoring" and insert -- pivoting --;

Column 4, line 49 delete "fitring" and insert -- fitting --;

Column 4, line 56 delete "pivoring" and insert -- pivoting --;

Column 4, lines 59, 60 and 62 delete "activaring" and insert -- activating --;

Column 4, line 63 delete "contacring" and insert -- contacting --;

Column 6, line 33 delete "deparring" and insert -- departing --;

Column 6, line 36 delete "limiring" and insert -- limiting --;

IN THE CLAIMS:

Column 6, line 44 delete "maring" and insert -- mating --;

Column 6, line 47 delete "inserring" and insert -- inserting --;

Column 6, lines 61, 62, 64 and 67 (twice) delete "activaring" and insert -- activating --;

UNITED STATES PATENT AND TRADEMARK OFFICE

CERTIFICATE OF CORRECTION

PATENT NO. : 5,476,335

DATED : December 19, 1995

INVENTOR(S) : Paul Whaley

It is certified that error appears in the above-indentified patent and that said Letters Patent is hereby corrected as shown below:

Column 7, line 8 delete "maring " and insert -- mating --;

Column 7, line 14 delete "inserring" and insert -- inserting --;

Column 7, lines 39, 53 and 64 delete "contacring" and insert -- contacting --;

Column 7, line 52 delete "activaring" and insert -- activating --;

Column 8, line 3 delete "activaring" and insert -- activating --;

Column 8, line 12 delete "maring" and insert -- mating --;

Column 8, line 17 delete "inserring" and insert -- inserting --;

Column 8, line 56 delete "contacring" and insert -- contacting --;

Column 9, lines 1 and 12 delete "contacring" and insert -- contacting --;

UNITED STATES PATENT AND TRADEMARK OFFICE

CERTIFICATE OF CORRECTION

PATENT NO. : 5,476,335

DATED : December 19, 1995

INVENTOR(S) : Paul Whaley

It is certified that error appears in the above-indentified patent and that said Letters Patent is hereby corrected as shown below:

Column 9, line 18 delete "activaring" and insert -- activating --;

Column 9, line 27 delete "maring" and insert -- mating --; and

Column 9, line 32 delete "inserring" and insert -- inserting --.

Signed and Sealed this

Twenty-first Day of July, 1998

*Attest:*

*Attesting Officer*

Bruce Lehman

BRUCE LEHMAN

*Commissioner of Patents and Trademarks*